US011508323B2

(12) United States Patent
Shao et al.

(10) Patent No.: US 11,508,323 B2
(45) Date of Patent: Nov. 22, 2022

(54) DISPLAY PANEL, DISPLAY DEVICE AND METHOD FOR DRIVING THE SAME

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Jiyang Shao, Beijing (CN); Yuxin Bi, Beijing (CN); Zhanshan Ma, Beijing (CN); Feng Gao, Beijing (CN); Feng Zi, Beijing (CN)

(73) Assignees: BEIJING BOE OPTOELECTRONICS TECHNOLOGY CO., LTD., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/330,489

(22) Filed: May 26, 2021

(65) Prior Publication Data

US 2022/0139344 A1 May 5, 2022

(30) Foreign Application Priority Data

Oct. 29, 2020 (CN) ..... 202011199871.2

(51) Int. Cl.

*G09G 3/34* (2006.01)
*G09F 9/33* (2006.01)
*G09F 9/37* (2006.01)

(52) U.S. Cl.

CPC ..... *G09G 3/3426* (2013.01); *G09F 9/33* (2013.01); *G09F 9/37* (2013.01); *G09G 2320/0233* (2013.01)

(58) Field of Classification Search

CPC . G09G 3/3426; G09G 2320/0233; G09F 9/33
See application file for complete search history.

(56) References Cited

U.S. PATENT DOCUMENTS 5,371,549 A * 12/1994 Park ..... H04N 5/45 348/564
2005/0116917 A1* 6/2005 Aoki ..... G09G 3/3688 345/99

(Continued)

FOREIGN PATENT DOCUMENTS

CN 101533611 A 9/2009
CN 109493774 A 3/2019
CN 110444152 A 11/2019

OTHER PUBLICATIONS

First Office Action for Chinese Application No. 202011199871.2, dated Dec. 31, 2021, 8 Pages.

(Continued)

*Primary Examiner* — Towfiq Elahi
(74) *Attorney, Agent, or Firm* — Brooks Kushman P.C.

(57) ABSTRACT

A display panel, a display device and a method for driving the display panel. The display panel includes: a rotation axis; at least one display area located at one side of the rotation axis; wherein the display area includes a plurality of display sub-areas; and a plurality of driving-control modules corresponding to the plurality of display sub-areas. The plurality of display sub-areas are sequentially arranged along a first direction; the first direction is directed from the rotation axis to the display area; when the display panel rotates around the rotation axis, areas passed by the plurality of display sub-areas form a plurality of imaging sub-areas. The plurality of driving-control modules are configured to control the plurality of display sub-areas to have different display param- (Continued)

eters, respectively, thereby enabling imaging brightness of the plurality of imaging sub-areas to be within a preset brightness range.

17 Claims, 8 Drawing Sheets

(56) References Cited

U.S. PATENT DOCUMENTS

2010/0295860 A1* 11/2010 Somerville ..... G09G 3/3216 345/545
2012/0013601 A1 1/2012 Park et al.
2013/0314457 A1 11/2013 Yasui et al.
2020/0350394 A1* 11/2020 Lou ..... H01L 27/3276
2021/0358406 A1 11/2021 Zhang et al.

OTHER PUBLICATIONS

Duan, Xianyin, et al., "Acquisition of Image Data for a Flat Screen Based True 3D Volumetric Display," Journal of Shandong University (Engineering Science), Apr. 2011, pp. 66-69, vol. 41, Issue 2 (5 Pages).
Second Office Action for Chinese Application No. 202011199871.2 dated Sep. 2, 2022, 12 Pages.
Li, Yan, "Research on True 3D Stereoscopic Display Technology," Full-text database of Chinese Excellent Master and Soil Dissertations Medical and Health Technology Series, Dec. 16, 2007-Jan. 15, 2008, pp. 25-31, Issue 01, 2008, Tongfang Knowledge Network Technology Co., Ltd., Beijing, China (8 Pages).

* cited by examiner

DISPLAY PANEL, DISPLAY DEVICE AND METHOD FOR DRIVING THE SAME

CROSS-REFERENCE TO RELATED APPLICATION

This application claims priority to Chinese Patent Application No. 202011199871.2 filed on Oct. 29, 2020, which is incorporated herein in its entirety.

TECHNICAL FIELD

The present application relates to the field of display technology, in particular to a display panel, a display device and a method for driving the display panel.

BACKGROUND

Three-dimensional display is also referred as true three-dimensional display, and displays an image which is a three-dimensional picture close to a real object in a real three-dimensional space, and allows multiple people to view a stereo image with naked eyes from multiple angles at the same time without any auxiliary equipment. Its principle is to use visual afterimage of human eyes, that is, persistence of vision.

However, spatial voxels formed by rotation displaying in the related art are sparse outside and dense inside, dark outside and bright inside, which results in a poor viewing effect for users. Thus, it is an urgent technical problem for those skilled in the art to improve the viewing effect of users.

SUMMARY

According to a first aspect of the present application, a display panel is provided and includes: a rotation axis; at least one display area located at one side of the rotation axis; wherein the display area includes a plurality of display sub-areas; and a plurality of driving-control modules corresponding to the plurality of display sub-areas. The plurality of display sub-areas are sequentially arranged along a first direction; the first direction is directed from the rotation axis to the display area; when the display panel rotates around the rotation axis, areas passed by the plurality of display sub-areas form a plurality of imaging sub-areas. The plurality of driving-control modules are configured to control the plurality of display sub-areas to have different display parameters, respectively, thereby enabling imaging brightness of the plurality of imaging sub-areas to be within a preset brightness range.

In some possible embodiments of the first aspect of the present application, the display parameters are frame frequencies; and the plurality of the driving-control modules are configured to control the plurality of the display sub-areas to have different frame frequencies and the frame frequencies of the plurality of the display sub-areas to be increased sequentially along the first direction.

In some possible embodiments of the first aspect of the present application, the display panel further includes: a memory module and a partition module; the memory module is electrically coupled to the partition module; the partition module is electrically coupled to the plurality of driving-control modules. Within a preset time, the memory module is configured to transmit a first preset number of data source slices to the partition module. The partition module is configured to divide each data source slice into a plurality of sub-slices corresponding to the plurality of display sub-areas, and transmit the plurality of sub-slices to the plurality of driving-control modules, respectively. Each of the plurality of driving-control modules is configured to receive a second preset number of the sub-slices according to the frame frequency of the display sub-area corresponding to the each of the plurality of driving-control modules, and control the display sub-area corresponding to the each of the plurality of driving-control modules to sequentially display the second preset number of the sub-slices. The second preset number is less than or equal to the first preset number.

In some possible embodiments of the first aspect of the present application, the numbers of the sub-slices received by the plurality of driving-control modules corresponding to the plurality of the display sub-areas are increased sequentially along the first direction.

In some possible embodiments of the first aspect of the present application, the plurality of display sub-areas include a first display sub-area, a second display sub-area and a third display sub-area which are sequentially arranges along the first direction. The plurality of sub-slices include a first sub-slice, a second sub-slice and a third sub-slice; the first sub-slice, the second sub-slice and the third sub-slice are corresponding to the first display sub-area, the second display sub-area and the third display sub-area, respectively. The plurality of driving-control modules at least include: a first driving-control module configured to receive a third preset number of first sub-slices and control the first display sub-area to sequentially display the third preset number of the first sub-slices; a second driving-control module configured to receive a fourth preset number of second sub-slices and control the second display sub-area to sequentially display the fourth preset number of the second sub-slices; and a third driving-control module configured to receive the fourth preset number of third sub-slices and control the third display sub-area to sequentially display the fourth preset number of the third sub-slices. When the third display sub-area displays the third sub-slices, two adjacent frame groups sequentially display two different third sub-slices, each frame group includes at least two frames, and a same third sub-slice is displayed in all frames of each frame group; the third preset number is less than the fourth preset number.

In some possible embodiments of the first aspect of the present application, each of the plurality of driving-control modules includes: an output control unit, a drive-chip control unit and a drive chip; the output control unit is electrically coupled to the partition module; the drive-chip control unit is electrically coupled to the output control unit; the drive chip is electrically coupled to the drive-chip control unit. The drive-chip control unit is configured to control the output control unit to output a second preset number of the sub-slices, according to the frame frequency of the display sub-area corresponding to the each of the plurality of driving-control modules. The drive chip is configured to receive the second preset number of the sub-slices and drive the display sub-area corresponding to the each of the plurality of driving-control modules to sequentially display the second preset number of the sub-slices.

In some possible embodiments of the first aspect of the present application, there is one display area at each side of the rotation axis, and the two display areas are symmetrically arranged with the rotation axis as an axis of symmetry; the plurality of display sub-areas in the two display areas are symmetrically arranged; in the two display areas, the display sub-areas at the same distance from the rotation axis are corresponding to the same driving-control module; or, the display area is at one side of the rotation axis.

In some possible embodiments of the first aspect of the present application, the display parameters are display brightness; and the display brightness of the plurality of display sub-areas are increased sequentially along the first direction.

In some possible embodiments of the first aspect of the present application, each of the plurality of display sub-areas includes a plurality of sub-regions; each of the plurality of driving-control modules includes a plurality of driving-control units corresponding to the plurality of sub-regions in a one-to-one manner; the plurality of driving-control units are configured to control the display parameters of the plurality of sub-regions, respectively; the display parameters of the sub-regions in the same display sub-area are the same.

In some possible embodiments of the first aspect of the present application, all of the plurality of sub-regions are divided into a plurality of attention areas; the driving-control units corresponding to a plurality of sub-regions in the plurality of attention areas have different levels of interference.

According to a second aspect of the present application, a display device is provided and includes a display panel with a rotation axis. The display panel includes: at least one display area located at one side of the rotation axis; wherein the display area includes a plurality of display sub-areas; and a plurality of driving-control modules corresponding to the plurality of display sub-areas in a one-to-one manner. The plurality of display sub-areas are sequentially arranged along a first direction; the first direction is directed from the rotation axis to the display area; when the display panel rotates around the rotation axis, areas passed by the plurality of display sub-areas form a plurality of imaging sub-areas. The plurality of driving-control modules are configured to control values of display parameters of the plurality of display sub-areas to be monotonically changed along the first direction, thereby enabling imaging brightness of the plurality of imaging sub-areas to be within a preset brightness range.

According to a third aspect of the present application, a method for driving any one of the foregoing display panel is provided and includes: dividing the display panel into areas according to a division rule, wherein the division rule includes dividing the display panel into a plurality of display sub-areas along a direction from a rotation axis to a display area; wherein the display panel includes a rotation axis for rotation, the display area is located on at least one side of the rotation axis; when the display panel rotates around the rotation axis, areas passed by the plurality of display sub-areas form a plurality of imaging sub-areas; and controlling the plurality of display sub-areas to have different display parameters, thereby enabling imaging brightness of the plurality of imaging sub-areas to be within a preset brightness range.

In some possible embodiments of the first aspect of the present application, the controlling the plurality of display sub-areas to have different display parameters, includes: controlling frame frequencies of the plurality of display sub-areas, which are arranged sequentially along the direction from the rotation axis to the display area, to be increased sequentially; wherein the frame frequencies are the display parameters.

In some possible embodiments of the first aspect of the present application, the controlling frame frequencies of the plurality of display sub-areas, which are arranged sequentially along the direction from the rotation axis to the display area, to be increased sequentially, includes: dividing each data source slice into a plurality of sub-slices corresponding to the plurality of display sub-areas; acquiring a second preset number of sub-slices corresponding to the frame frequency of each of the plurality of display sub-areas within a preset time period, and enabling the each of the plurality of display sub-areas to sequentially display the second preset number of sub-slices.

In some possible embodiments of the first aspect of the present application, the display parameters are display brightness; the controlling the plurality of display sub-areas to have different display parameters, includes: controlling display brightness of the plurality of display sub-areas, which are arranged sequentially along the direction from the rotation axis to the display area, to be increased sequentially.

It is to be understood that the contents in this section are not intended to identify the key or critical features of the embodiments of the present application, and are not intended to limit the scope of the present application. Other features of the present application will become readily apparent from the following description.

BRIEF DESCRIPTION OF THE DRAWINGS

The drawings are included to provide a better understanding of the application and are not to be construed as limiting the application. Wherein.

Figure 1:
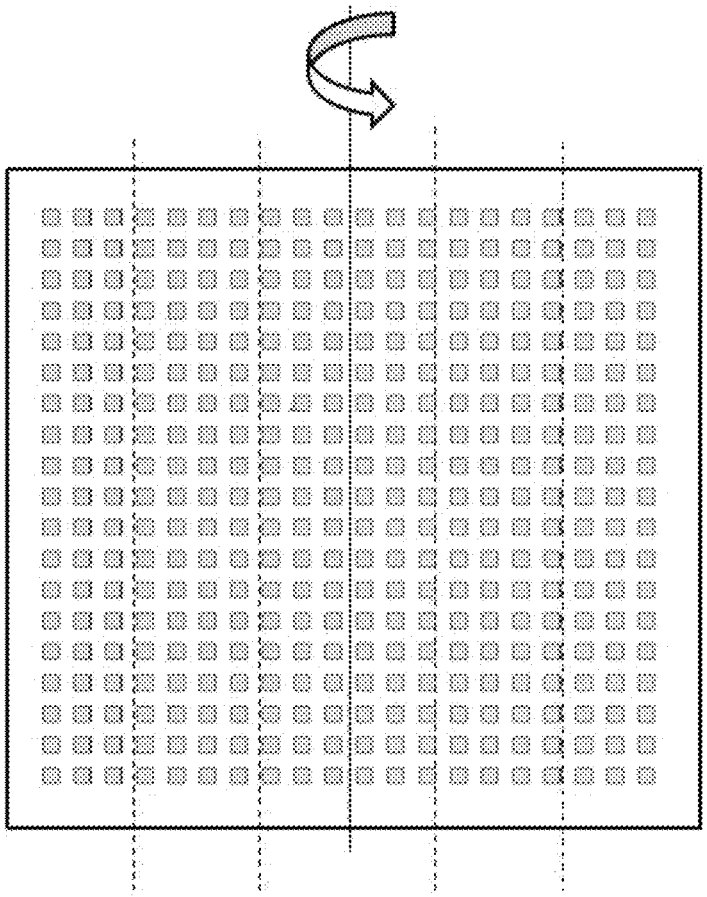
FIG. 1 is a schematic diagram of a display panel provided in the related art.

| Reference numerals | |
|---|---|
| 1-rotation axis; | 2-display area; |
| 21-display subarea; | 211- first display sub-area; |
| 212-second display sub-area; | 213-third display sub-area; |
| 214-sub-region; | 31-first imaging sub-area; |
| 32-second imaging sub-area; | 33- third imaging sub-area; |
| 4-driving-control module; | 41-driving-control sub-module; |
| 411-output control unit; | 412-drive-chip control unit; |
| 413-drive chip; | 5-memory module; |
| 6-partition module; | 7-data source slice; |
| 71-first sub-slice; | 72-second sub-slice; |
| 73-third sub-slice; | 81-core attention area; |
| 82-secondary attention area; | 83-non-attention area; |
| 9-display control module; | 10-drive control circuit. |

DETAILED DESCRIPTION

Reference will now be made in detail to the exemplary embodiments of the present application, examples of which are illustrated in the accompanying drawings, wherein the various details of the embodiments of the present application are included to facilitate understanding and are to be considered as exemplary only. Accordingly, a person skilled in the art should appreciate that various changes and modifications can be made to the embodiments described herein without departing from the scope and spirit of the present application. Also, descriptions of well-known functions and structures are omitted from the following description for clarity and conciseness.

The terms such as "first" and "second" in the specification and claims of the present application are merely used to differentiate similar components rather than to represent any order or sequence. It is to be understood that the data so used may be interchanged where appropriate, such that the embodiments of the present application described herein may be implemented in a sequence other than those illustrated or described herein. In addition, the terms "include" and "have" or their variations are intended to encompass a non-exclusive inclusion, such that a process, method, system, product, or device that include a series of steps or units include not only those steps or units that are explicitly listed but also other steps or units that are not explicitly listed, or steps or units that are inherent to such process, method, product, or device. In the specification and claims, "and/or" means at least one of the connected objects.

Figure 2:
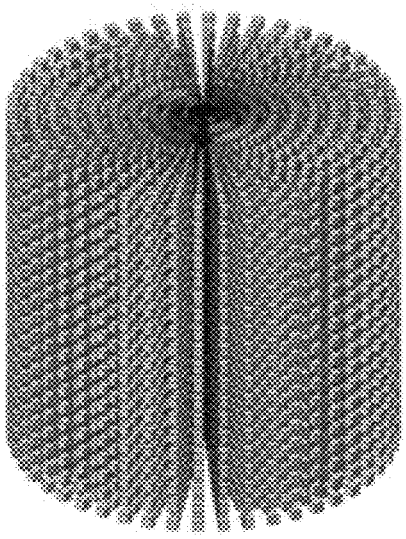
FIG. 2 is a schematic diagram showing arrangement of voxels of a display panel provided in the related art.
Figure 3:
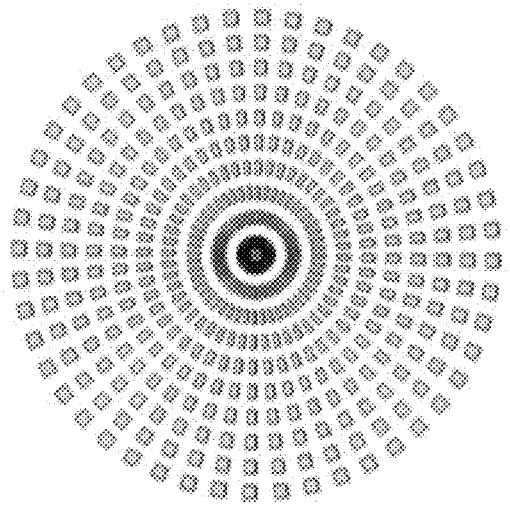
FIG. 3 is another schematic diagram showing arrangement of voxels of a display panel provided in the related art.

A basic model for rotation displaying is shown in FIG. 1. A screen rotates at a high speed until an entity of the screen becomes transparent. After surface displaying is rotated, due to the imaging principle, during the rotation process, screen pixels are scanned and displayed in space to form spatial voxels as shown in FIG. 2. As shown in FIG. 3, the greater a distance between a pixel and a rotation axis, the longer an arc traversed by the pixel in a certain unit of time; the greater a distance between voxels and the rotation axis, the sparser an arrangement of voxels. The voxels are spatial pixels. In the related art, brightness and frame frequency are the same everywhere in the surface displaying, and thus the spatial voxels formed by the rotation displaying are sparse outside and dense inside, dark outside and bright inside, which results in a poor viewing effect for users. Thus, it is an urgent technical problem for those skilled in the art to improve the viewing effect of users.

In view of this, embodiments of the present application provide a display panel, a display device and a method for driving the display panel, which can improve the viewing effect of users.

Figure 4:
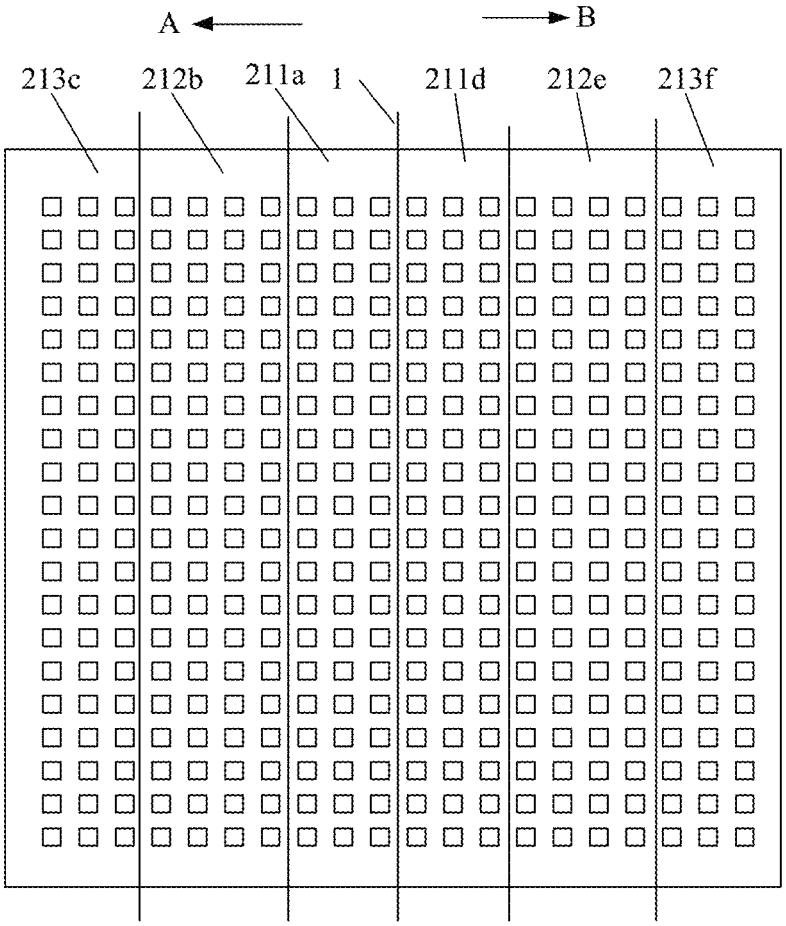
FIG. 4 is a schematic diagram of a display panel according to an embodiment of the present application.
Figure 5:
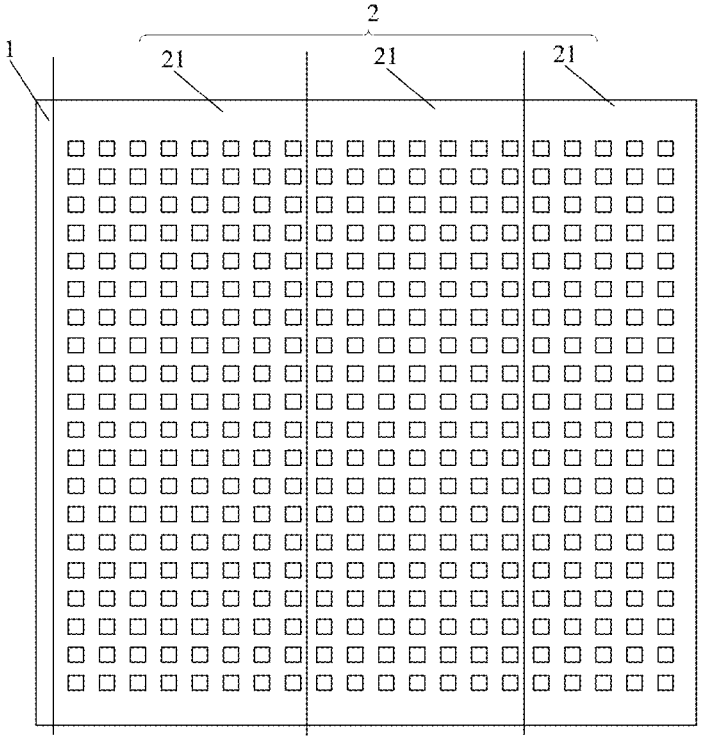
FIG. 5 is another schematic diagram of a display panel according to an embodiment of the present application.
Figure 10:
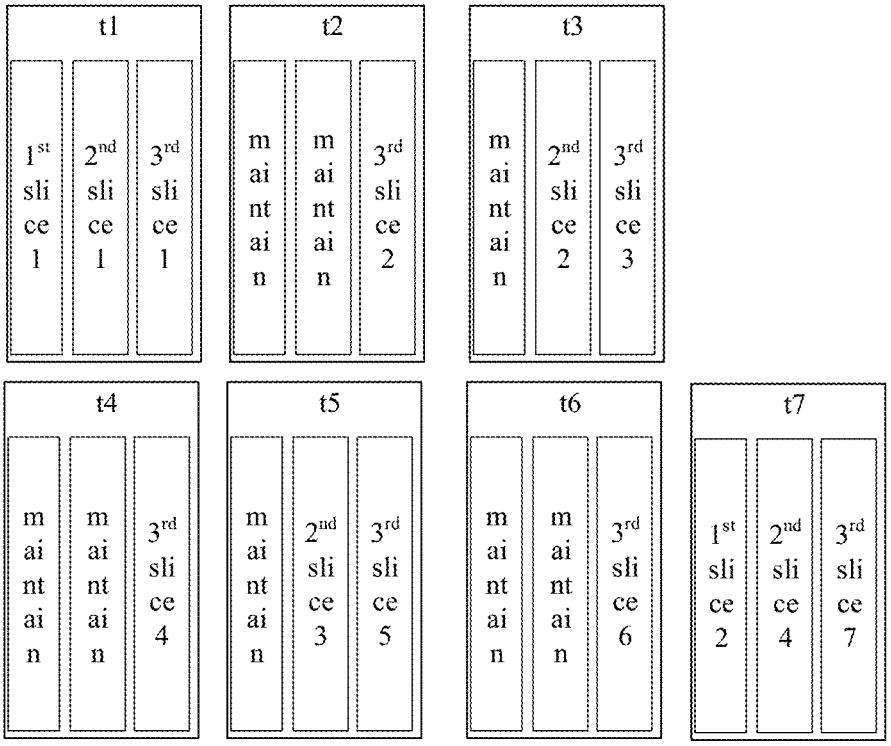
FIG. 10 is a schematic diagram of displaying of a display panel according to an embodiment of the present application.
Figure 11:
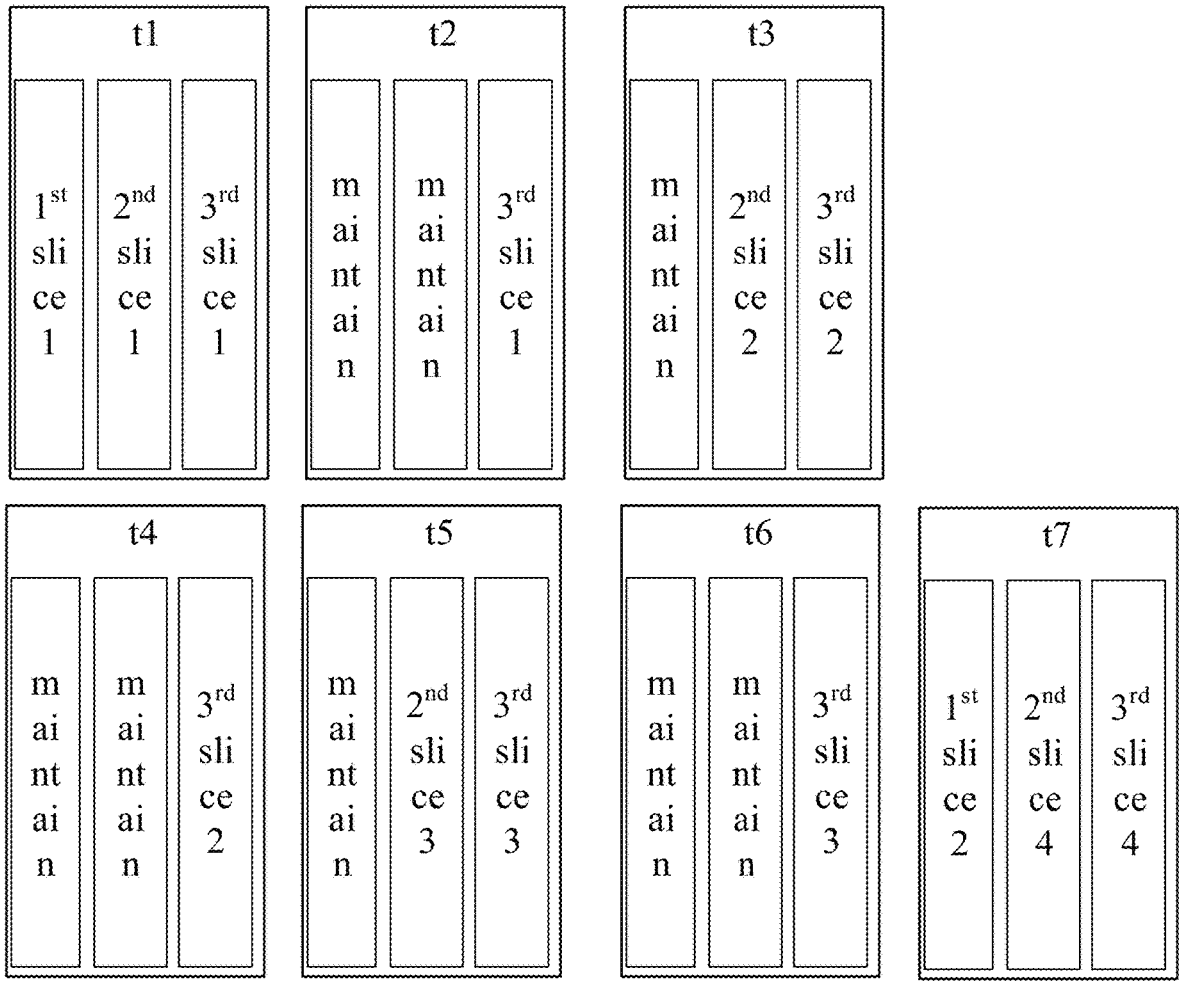
FIG. 11 is another schematic diagram of displaying of a display panel according to an embodiment of the present application.
Figure 12:
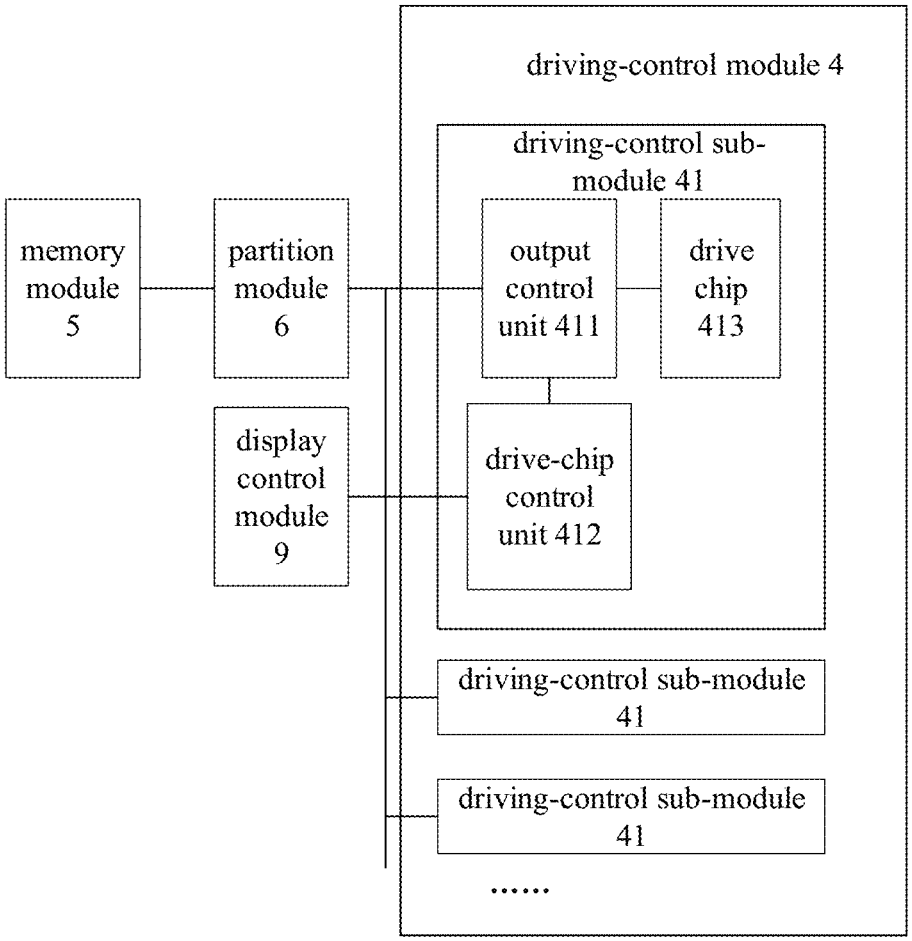
FIG. 12 is another schematic diagram of a display panel according to an embodiment of the present application.

According to a first aspect of the present application, a display panel is provided. As shown in FIG. 4 to FIG. 14, the display panel includes: a rotation axis 1 and at least one display area 2 (as shown in FIG. 5) located at one side of the rotation axis 1. The display area 2 includes a plurality of display sub-areas 21. The plurality of display sub-areas 21 are sequentially arranged along a first direction. The first direction is directed from the rotation axis 1 to the display area 2. When the display panel rotates around the rotation axis 1, areas passed by the plurality of display sub-areas 21 form a plurality of imaging sub-areas. The display area 2 further includes a plurality of driving-control modules 4 (as shown in FIG. 12) corresponding to the plurality of display sub-areas 21. The driving-control modules 4 are used to control the plurality of display sub-areas 21 to have different display parameters, respectively, so that imaging brightness of the imaging sub-areas are within a preset brightness range.

Figure 7:
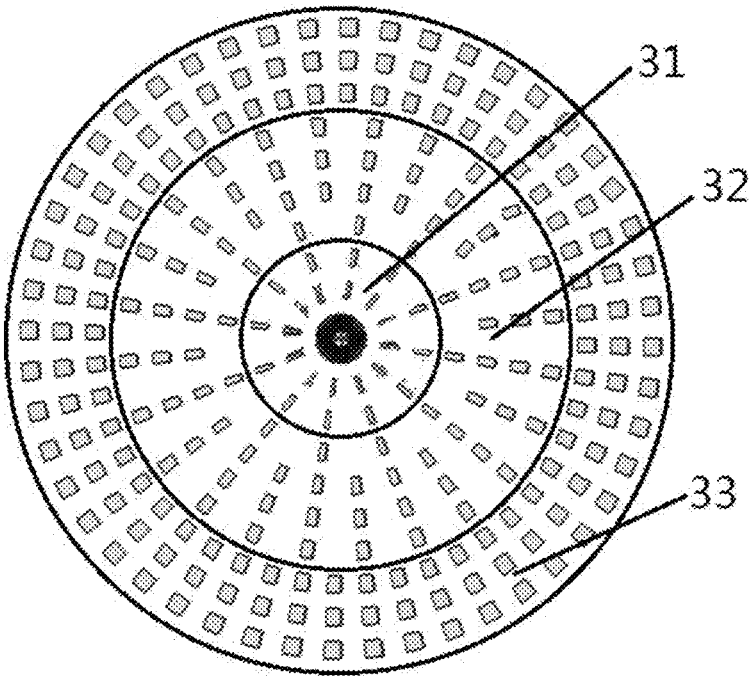
FIG. 7 is a schematic diagram of an imaging area of a display panel according to an embodiment of the present application.

The foregoing display panel can rotate around the rotation axis 1. As shown in FIG. 4, the rotation axis 1 can divide the display panel into two display areas 2, that is, the two display areas 2 are located at two sides of the rotation axis 1, respectively. Each display area 2 includes multiple display sub-areas 21. The multiple display sub-areas 21 in each display area 2 are sequentially arranged along the first direction. As shown in FIG. 4, an arrow A represents a first direction in one display area, and an arrow B represents a first direction in the other display area. The two display areas 2 may be referred to as a first display area and a second display area. The multiple display sub-areas 21 in the first display area 2 are sequentially arranged along a direction from the rotation axis 1 to the first display area 2. The multiple display sub-areas 21 in the second display area 2 are sequentially arranged along a direction from the rotation axis 1 to the second display area 2. The two display areas 2 may be symmetrically arranged, and then the multiple display sub-areas 21 in the two display areas 2 are also symmetrically arranged. Of course, the multiple display sub-areas 21 in the two display areas 2 may also be arranged asymmetrically. In addition, as shown in FIG. 5, the rotation axis 1 may be located at one side of the display panel, and then the display panel includes only one display area 2. When the display panel rotates around the rotation axis 1, each display sub-area 21 rotates around the rotation axis 1, and an area traversed by each display sub-area 21 in space is an imaging sub-area. When the display panel rotates, a cylindrical imaging area is formed in the space. An axis of the cylindrical imaging area is the rotation axis 1 of the display panel. The cylindrical imaging area is divided into multiple imaging sub-areas corresponding to the display sub-areas 21. Each imaging sub-area surrounds the rotation axis 1. As shown in FIG. 7, a first imaging sub-area 31, a second imaging sub-area 32 and a third imaging sub-area 33 are all imaging sub-areas. When the multiple display sub-areas 21 in the two display areas 2 are symmetrically arranged, the two symmetrically arranged display sub-areas 21 are corresponding to a same imaging sub-area. When the display area 2 is provided at only one side of the rotation axis 1, one display sub-area 21 is corresponding to one imaging sub-area.

In the related art, when the display panel displays a picture, display parameters of the display panel are consistent everywhere, which results in a larger imaging brightness of the imaging sub-areas close to the rotation axis 1 and a smaller imaging brightness of the imaging sub-areas far away from the rotation axis 1, thereby resulting in uneven imaging brightness of the display panel and a poor viewing effect for users. While in the display panel provided in the present application, multiple driving-control modules 4 are included and are corresponding to the multiple display sub-areas 21 in a one-to-one manner, that is, each display sub-areas 21 can be individually controlled by the corresponding driving-control module 4. Therefore, different driving-control modules 4 can control different display sub-areas 21 to have different display parameters, so that imaging brightness of the imaging sub-areas corresponding to the different display sub-areas 21 are within the preset brightness range. In order to ensure that users have the best viewing effect, the imaging brightness of multiple imaging sub-areas should be the same. However, due to errors and other reasons, the imaging brightness of each imaging sub-area may float within the preset brightness range. At this point, a brightness difference between various imaging sub-areas is less than a preset value. Since the brightness difference between various imaging sub-areas is small and will not be detected by the human eyes, the viewing effect of the users is also guaranteed. The display panel provided in this embodiment may be any one of an OLED display panel, a MINI LED display panel, or a Micro LED display panel.

In some modified implementations of the first aspect of the present application, controlling the multiple display sub-areas 21 to have different display parameters specifically includes: controlling frame frequencies of the multiple display sub-areas 21 arranged sequentially along the first direction to increase sequentially, where the frame frequency is a display parameter.

Figure 9:
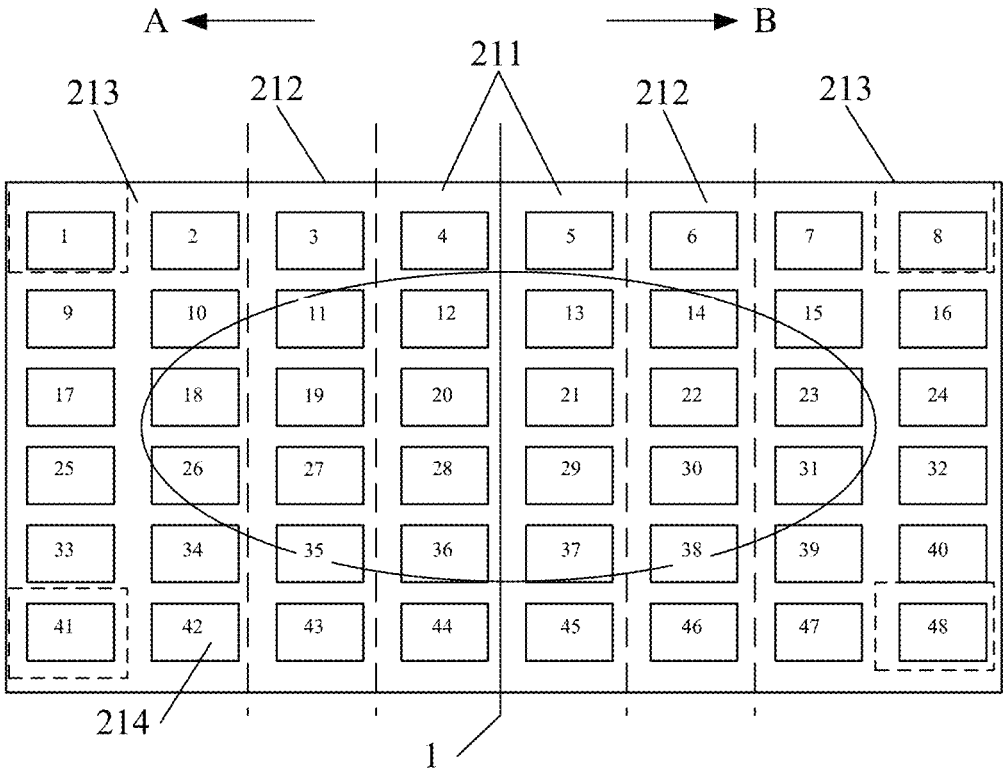
FIG. 9 is still another schematic diagram of a display panel according to an embodiment of the present application.

The frame frequency is a refresh rate of the display panel. In a case that the number of rotations remains unchanged and the frame frequencies are different, it means that the numbers of slices are different when the display panel rotates for one revolution. In a case of a same display frame frequency. The smaller the distance from one display sub-area to the rotation axis 1 serving as a rotating shaft, the greater the arrangement density of voxels in an imaging sub-area corresponding to the one display sub-area, and the greater the brightness of the imaging sub-area corresponding to the one display sub-area during rotation displaying. On the contrary, the greater the distance from one display sub-area to the rotation axis 1 serving as the rotating shaft, the smaller the arrangement density of voxels in an imaging sub-area corresponding to the one display sub-area, and the smaller the brightness of the imaging sub-area corresponding to the one display sub-area during rotation displaying. Therefore, in the related art, during rotation displaying, an arrangement density of voxels is gradually reduced along a direction from the rotation axis 1 to the imaging area, which results in that imaging brightness sequentially decreases. It can be known from the above analysis that the imaging brightness of various imaging sub-areas can be adjusted by adjusting the arrangement densities of voxels in various imaging sub-areas. Adjustment of the arrangement densities of voxels in various imaging sub-areas may be achieved by adjusting frame frequencies. Specifically, the imaging sub-areas may include a first imaging sub-area 31 and a second imaging region 32. A distance between the first imaging sub-area 31 and the rotation axis 1 is smaller than a distance between the second imaging sub-area 32 and the rotation axis 1. Therefore, in the related art, an imaging brightness of the first imaging sub-area 31 is greater than an imaging brightness of the second imaging sub-area 32. In order to reduce the imaging brightness difference between the first imaging sub-area 31 and the second imaging sub-area 32, an arrangement density of voxels in the first imaging sub-area 31 should be reduced and/or an arrangement density of voxels in the second imaging sub-area 32 should be increased, and this can be achieved by reducing a frame frequency in the first display sub-area 211 (as shown in FIG. 9) corresponding to the first imaging sub-area 31 and/or increasing a frame frequency of the second display sub-area 212 (as shown in FIG. 9) corresponding to the second imaging sub-area 32. In summary, by setting the frame frequency of the first display sub-area 211 to be smaller than the frame frequency of the second display sub-area 212, an arrangement density of voxels in the first imaging sub-area 31 corresponding to the first display sub-area 211 is equal to an arrangement density of voxels in the second imaging sub-area 32 corresponding to the second display sub-area 212. Then, an imaging brightness of the first imaging sub-area 31 is equal to an imaging brightness of the second imaging sub-area 32. As shown in FIG. 7, it shows arrangement densities of voxels in various imaging sub-areas in this embodiment. Therefore, by sequentially increasing frame frequencies of the display sub-areas 21 which are sequentially arranged along the first direction, it can be ensured that arrangement densities of voxels of multiple imaging sub-areas are the same or within a preset density range.

Specifically, as shown in FIG. 12, the display panel further includes: a memory module 5 and a partition module 6. The memory module 5 is electrically coupled to the partition module 6. The partition module 6 is electrically coupled to the driving-control module 4. Within a preset time, the memory module 5 is used to transmit a first preset number of data source slices 7 to the partition module 6. The partition module 6 is used to divide each data source slice 7 into multiple sub-slices corresponding to multiple display sub-areas 21, and transmit the multiple sub-slices to the multiple driving-control modules 4, respectively. The driving-control module 4 is used to receive a second preset number of the sub-slices according to the frame frequency of the display sub-area 21 corresponding to the driving-control module 4, and control its corresponding display sub-area 21 to sequentially display the second preset number of the sub-slices. The second preset number is less than or equal to the first preset number.

The memory module 5 can receive the data source slice 7 and transmit it to the partition module 6 under control of a memory control module. Specifically, a communication module may be provided in the display device. The communication module may be Bluetooth or AP, which is used to interact with external devices to achieve wireless communication. After the memory module 5 receives the data source slice 7, the memory module 5 transmits the data source slice 7 to the partition module 6 under control of a display control module 9. That is, the display control module 9 can control the memory module 5 to store and retrieve the data source slice 7. The memory module 5 may be a double data rate synchronous dynamic random access memory (DDR), or a memory module in a field programmable gate array (FPGA). Each data source slice 7 is corresponding to each display area 2 of the display panel. The data source slice 7 is partitioned by the partition module 6 into multiple sub-slices which can be displayed in the corresponding display sub-areas 21, respectively. The number of data source slices 7 transmitted to the partition module 6 is equal to the first preset number, and then the number of sub-slices corresponding to each display sub-area 21 is also equal to the first preset number. Then, the driving-control module 4 receives the second preset number of sub-slices according to the frame frequency of the display sub-area 21 corresponding to the driving-control module 4, and controls its corresponding display sub-area 21 to sequentially display the second preset number of sub-slices. The second preset numbers corresponding to various driving-control modules 4 may be the same or different.

Specifically, the numbers of the sub-slices received by the driving-control modules 4 corresponding to the plurality of the display sub-areas 21, increase sequentially along the first direction.

Figure 6:
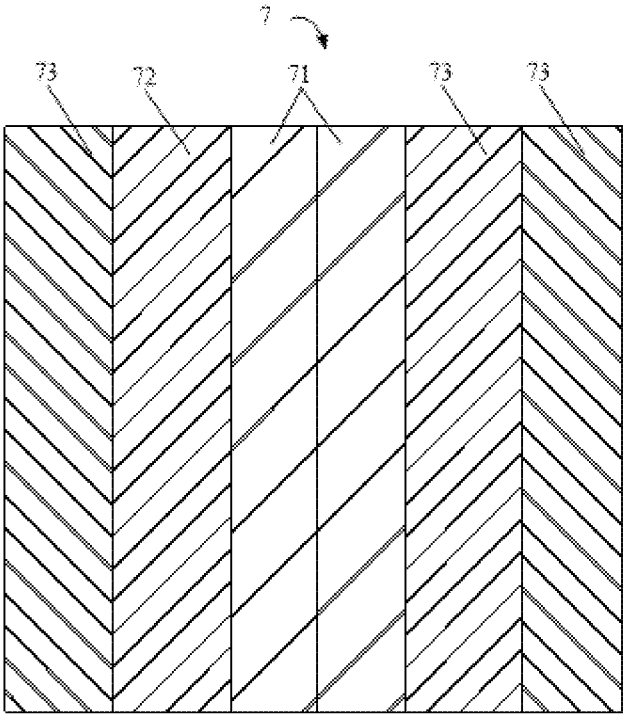
FIG. 6 is a schematic diagram of data source slices displayed on a display panel according to an embodiment of the present application.

In the display area 2, as shown in FIG. 4, multiple display sub-areas 21 may include a first display sub-area 211, a second display sub-area 212 and a third display sub-area 213 in sequence along a first direction A or a first direction B. In this embodiment, only three display sub-areas 21 are taken as an example for description. In addition, the number and coverage areas of display sub-areas 21 may be set according to requirements. The first display sub-area 211, the second display sub-area 212 and the third display sub-area 213 are corresponding to a first driving-control module 4, a second driving-control module 4 and a third driving-control module 4, respectively. Therefore, frame frequencies of the first display sub-area 211, the second display sub-area 212 and the third display sub-area 213 are increases successively; and the number of sub-slices received by the corresponding first, second, and third driving-control modules successively increases. In this way, final displaying effects of various display sub-areas 21 are as follows: as shown in FIG. 6, the sub-slices corresponding to the first, second and third display sub-areas 211, 212, and 213 are the first, second and third sub-slices 71, 72, 73, respectively; and the frame frequency corresponding to the third display sub-area 213 is the largest, and thus the number of third sub-slices 73 received by the third driving-control module 4 is the largest, and its refresh rate is the largest. As shown in FIG. 10, the third driving-control module 4 corresponding to the third display sub-area 213, can control the third display sub-area 213 to display a third sub slice 1 at t1, display a third sub slice 2 at t2, display a third sub slice 3 at t3, display a third sub slice 4 at t4, display a third sub slice 5 at t5, and display a third sub slice 6 at t5, where t1 . . . T6 are consecutive six frames of the third display sub-area 213. The second display sub-area 212 displays a second sub-slice 1 at t1, displays a second sub-slice 2 at t3 and displays a second sub-slice 3 at t5, where t1, t3 and t5 are three consecutive frames of the second display sub-area 212. At t2, t4, and t6, the second driving-control module 4 corresponding to the second display sub-area 212 outputs no second sub-slice 72, that is, the second display sub-area 212 is not refreshed. At this time, the driving-control module 4 corresponding to the second display sub-area 212 transmits zero-filled data or no data, the second sub-slice 1 displayed at t1 is maintained at t2, the second sub-slice 2 displayed at t3 is maintained at t4, and the second sub-slice 3 displayed at t5 is maintained at t6. The first display sub-area 211 displays a first sub-slice 1 at t1 and displays a first sub-slice 2 at t7, where t1 and t7 are two consecutive frames of the first display sub-area 211. The first display sub-area 211 is nor refreshed from t2 to t6, that is, the first driving-control module 4 corresponding to the first display sub-area 211 output no first sub-slice. At this time, the driving-control module 4 corresponding to the first display sub-area 211 transmits zero-filled data or no data, and the first sub-slice 1 displayed at t1 is maintained from t2 to t6.

Specifically, as shown in FIG. 4 and FIG. 6, multiple display sub-areas 21 include a first display sub-area 211, a second display sub-area 212 and a third display sub-area 213 that are sequentially arranged along the first direction. Multiple sub-slices include a first sub-slice 71, a second sub-slice 72 and a third sub-slice 73, which are corresponding to the first display sub-area 211, the second display sub-area 212 and the third display sub-area 213, respectively. Multiple driving-control modules 4 at least include: a first driving-control module 4 configured to receive a third preset number of first sub-slices 71 and control the first display sub-area 211 to sequentially display the third preset number of the first sub-slices 71; a second driving-control module 4 configured to receive a fourth preset number of second sub-slices 72 and control the second display sub-area 212 to sequentially display the fourth preset number of the second sub-slices 72; a third driving-control module 4 configured to receive the fourth preset number of third sub-slices 73 and control the third display sub-area 213 to sequentially display the fourth preset number of the third sub-slices 73. When the third display sub-area 213 displays the third sub-slices 73, two adjacent frame groups sequentially display two different third sub-slices 73. Each frame group includes at least two frames, and a same third sub-slice 73 is displayed in all frames of each frame group. The third preset number is less than the fourth preset number. The third preset quantity and the fourth preset quantity both belong to the second preset quantity.

This embodiment provides another implementation manner in which multiple display sub-areas 21 have different frame frequencies. In this embodiment, the number of sub-slices received by two driving-control modules 4 may be the same, but frame frequencies of display sub-areas 21 corresponding to the two driving-control modules 4 are different. The first driving-control module 4 receives a third preset number of first sub-slices 71, and controls the first display sub-areas 211 to sequentially display the third preset number of first sub-slices 71 in the third preset number of consecutive frames. The second driving-control module 4 receives the fourth preset number of second sub-slices 72, and controls the second display sub-area 212 to sequentially display the fourth preset number of second sub-slices 72 in the fourth preset number of consecutive frames. A time period corresponding to the third preset number of frames in the first display sub-area 211 and a time period corresponding to the fourth preset number of frames in the second display sub-area 212 are the same, and both are a preset time period. The third driving-control module 4 receives a fourth preset number of third sub-slices 73, which are stored by a drive chip 413 in the driving-control module 4 and are repeatedly output in a multiplied frequency until a new third sub-slice 73 arrives. Specifically, the third driving-control module 4 controls the third display sub-area 213 to sequentially display the fourth preset number of third sub-slices 73 in the fourth preset number of consecutive frame groups. A same third sub-slice 73 is displayed in multiple frames in each frame group and each frame group includes n frames. Therefore, within a preset time period, the third display sub-area 213 is refreshed n times the fourth preset number. Specific display effects of the above embodiment is that: as shown in FIG. 11, the first display sub-area 211 is refreshed and displays the first sub-slices 1 and 2 in sequence at t1 and t7; and the second display sub-area 212 is refreshed and displays the second sub-slices 1, 2, and 3 in sequence at t1, t3, and t5, and is not refreshed at t2, t4, and t6; while the third display sub-area 213 is refreshed and displays sequentially at t1 . . . t6, where t1 and t2 belong to the first frame group, that is, the third sub-slice 1 is displayed at both t1 and t2; t3 and t4 belong to the second frame group, that is, the third sub-slice 2 is displayed at both t3 and t4; t5 and t6 belong to the third frame group, that is, the third sub-slice 3 is displayed at both t5 and t6. The number of the first display sub-area 211, the second display sub-area 212, and the third display sub-area 213 in the display panel may be one or more, which may be specifically set according to actual needs.

Specifically, as shown in FIG. 12, the driving-control module 4 includes: an output control unit 411, a drive-chip control unit 412 and a drive chip 413. The output control unit 411 is electrically coupled to the partition module 6. The drive-chip control unit 412 is electrically coupled to the output control unit 411. The drive chip 413 is electrically coupled to the output control unit 411. The drive-chip control unit 412 controls the output control unit 411 to output a second preset number of the sub-slices, according to the frame frequency of the display sub-area 21 corresponding to the driving-control module 4. The drive chip 413 is configured to receive a second preset number of sub-slices and drive the display sub-area 21 to sequentially display the second preset number of sub-slices.

The output control unit 411 can output sub-slices to the drive chip 413 under control of the drive-chip control unit 412. The drive chip 413 can receive data valid signal and frame start signal transmitted by a display control module 9. The data valid signal and frame start signal can reflect the frame frequency of the display sub-area 21. In addition, the output control unit 411 can further convert data format of output sub-slices into a format that can be recognized by the drive chip 413. The drive chip 413 controls the display sub-area 21 to sequentially display sub-slices.

Specifically, as shown in FIG. 4, there is one display area 2 at each side of the rotation axis 1, and two display areas 2 are symmetrically arranged with the rotation axis 1 as an axis of symmetry. Multiple display sub-areas 21 in the two display areas 2 are symmetrically arranged. In the two display areas 2, the display sub-areas 21 at the same distance from the rotation axis 1 are corresponding to the same driving-control module 4. Alternative, as shown in FIG. 5, one display area 2 is provided at one side of the rotation axis 1.

As shown in FIG. 4, in the first display area 2, a first display sub-area 211*a*, a second display sub-area 212*b* and a third display sub-area 213*c* are sequentially arranged along a first direction A. In the second display area 2, a first display sub-area 211*d*, a second display sub-area 212*e* and a third display sub-area 213*f* are sequentially arranged along a first direction B. The first display sub-area 211*a* and the first display sub-area 211*d* are controlled by the first driving-control module 4. The second display sub-area 212*b* and the second display sub-area 212*e* are controlled by the second driving-control module 4. The third display sub-area 213*c* and the third display sub-area 213*f* are controlled by the third driving-control module 4.

In addition, the rotation axis 1 may also be located at one side of the display panel. At this point, only one side of the rotation axis 1 is provided with the display area 2.

Specifically, the display parameter is display brightness, and the display brightness of multiple display sub-areas 21 increase sequentially along the first direction.

In the related art, display brightness of multiple imaging sub-areas are sequentially reduced in a direction from a rotation axis to the imaging sub-areas. Then, by reducing an imaging brightness of an imaging sub-area close to the rotation axis 1 and/or increasing an imaging brightness of an imaging sub-area away from the rotation axis 1, the imaging brightness of the multiple imaging sub-areas are equal. Therefore, by setting a display brightness of a display sub-area 21 close to the rotation axis 1 to be smaller than a display brightness of a display sub-area 21 away from the rotation axis 1, it can ensure that the imaging brightness of multiple imaging sub-areas are the same. Therefore, in this embodiment, the display brightness of the multiple display sub-areas 21 are increased sequentially along the first direction, that is, the display brightness of the display sub-area 21 close to the rotation axis 1 is smaller than the display brightness of the display sub-area 21 away from the rotation axis 1, thereby ensuring that imaging brightness of multiple imaging sub-areas are the same or within a preset brightness range. Parameters for controlling display brightness may include a gray value and a maximum brightness. In this embodiment, gray values or maximum brightness of multiple display sub-areas 21 may be gradually increased along the first direction.

Specifically, each of the display sub-areas 21 includes multiple sub-regions 214 (as shown in FIG. 9). The driving-control module 4 includes multiple driving-control units corresponding to the multiple sub-regions 214 in a one-to-one manner. The multiple driving-control units are configured to control display parameters of the multiple sub-regions 214, respectively. The display parameters of the sub-regions 214 in the same display sub-area 21 are the same.

Figure 13:
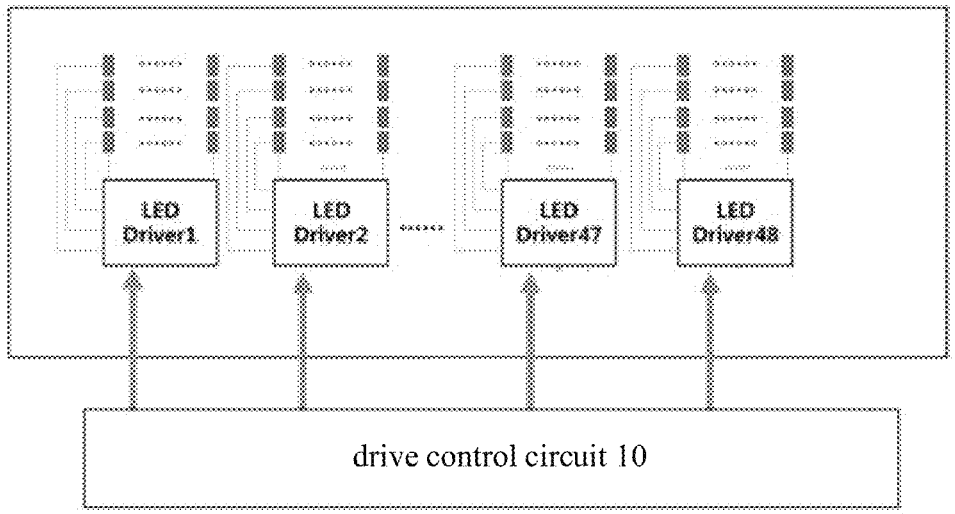
FIG. 13 is still another schematic diagram of a display panel according to an embodiment of the present application.
Figure 14:
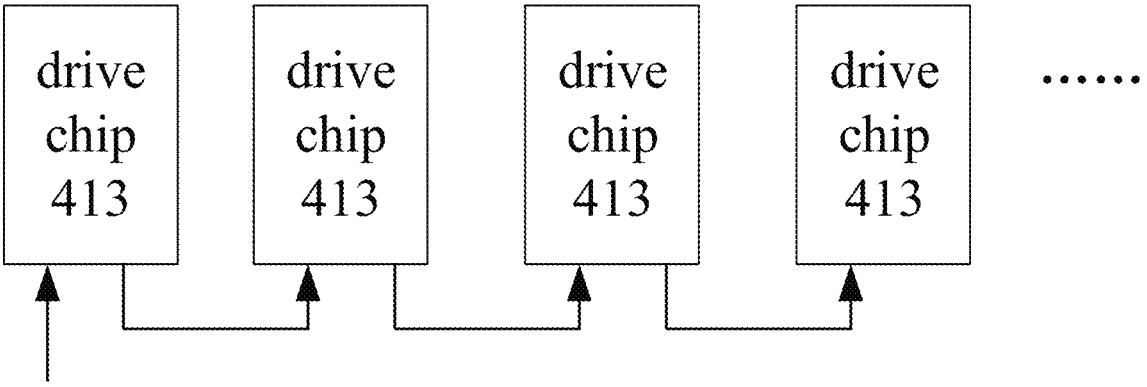
FIG. 14 is yet another schematic diagram of a display panel according to an embodiment of the present application.

The display sub-area 21 is further partitioned, and one driving-control module 4 is corresponding to one display sub-area 21. As shown in FIG. 12, one driving-control module 4 includes the same number of driving-control sub-modules 41 as the sub-regions 214 in the display sub-area 21. Each driving-control sub-module 41 includes an output control unit 411, a drive-chip control unit 412 and a drive chip 413. The sub-regions 214 in the same display sub-area 21 have the same frame frequency. Since the processing speed of each driving-control sub-module 41 is limited, the larger an area of the sub-region 214 corresponding to one driving-control sub-module 41, the more pixels in the sub-region 214, and the smaller the refresh rate of the sub-region 214. In this embodiment, each display sub-area 21 is driven by multiple driving-control sub-modules 41, which can increase the refresh rate of the display sub-area 21, thereby achieving ultra-high frame display, and reducing system data processing burden of each driving-control sub-module 41 as compared with the technical solution in which one driving-control sub-module 41 drives an entire display area 2 of a display panel. The sub-region 214 adopts an LED passive driving mode. In addition, the display panel further includes a power module for converting an input voltage into a relevant voltage required by a driving-control circuit 10. The driving-control circuit 10 includes a memory module 5, a partition module 6, and an output control unit 411 as well as a drive-chip control unit 412 in the driving-control module 4. As shown in FIG. 13, the driving-control circuit 10 may adopt a programmable logic device, and drive multiple sub-regions 214 in parallel. In FIG. 13, LED driver is a drive chip. Of course, as shown in FIG. 14, the sub-regions 214 may also be jointly driven by the driving-control sub-modules 41 that are connected in series, and the sub-regions 214 may be independently controlled by the driving-control sub-module 41. As shown in FIG. 14, each sub-region 214 may be driven by using one or more cascaded programmable logic circuits to drive the drive chips 413 in parallel.

Specifically, as shown in FIG. 9, all the sub-regions 214 are divided into multiple attention areas. The driving-control units corresponding to multiple sub-regions 214 in the multiple attention areas have different levels of interference.

Figure 8:
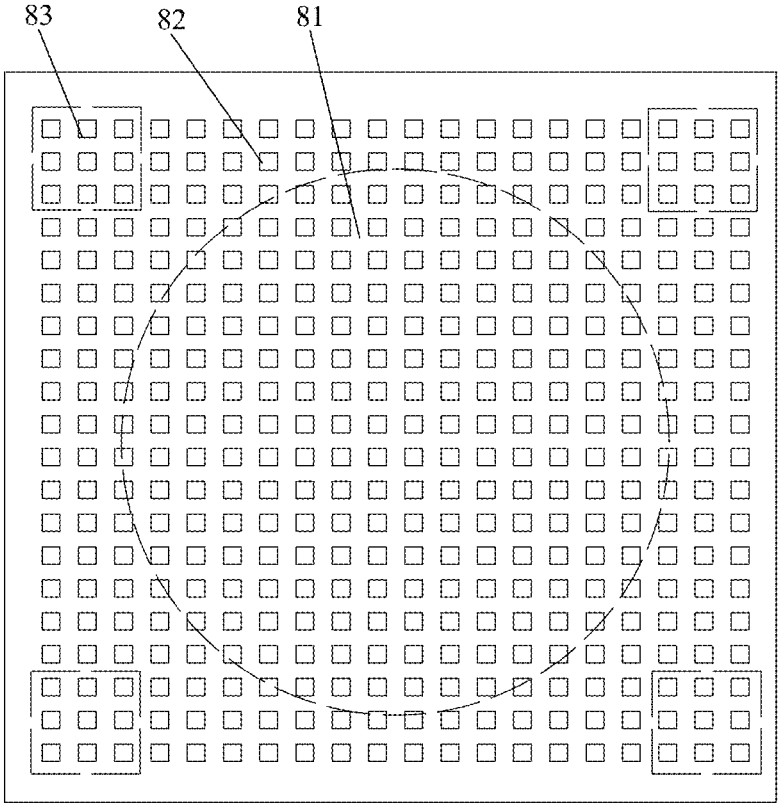
FIG. 8 is another schematic diagram of a display panel according to an embodiment of the present application.

According to data distribution characteristics of demo to be displayed in the rotation displaying, the display panel may be divided into multiple attention areas according to usage frequency of pixels. Therefore, usage frequencies of pixels in different attention areas are different. Circuit performance optimization processing is performed in an attention area with the highest usage frequencies of pixels. The driving-control unit in the attention area with the highest usage frequencies of pixels, has the least interference. Specifically, the display panel may be circular, elliptical or rectangular. The display panel may be divided into a core attention area 81 (as shown in FIG. 8) and a secondary attention area 82 (as shown in FIG. 8). Usage frequencies of pixels in the core attention area 81 and the secondary attention area 82 are decreased sequentially. The core attention area 81 is located in the middle of the display panel. The secondary attention area 82 circles the core attention area 81. Interference degrees of the driving-control sub-module 41 in the core attention area 81 and the driving-control sub-module 41 in the secondary attention area 82 are sequentially reduced. Circuit performance optimization processing may be performed on the driving-control sub-module 41 in the core attention area 81, so that a circuit with the best signal control part clock performance (such as the best performance pin in FPGA) and the least signal environment interference, is configured to the core attention area 81. FPGA is a programming logic device, which may include a communication module, a memory module 5, a partition module 6, a display control module 9, a memory control module, and an output control unit 411 in the driving-control module 4. The memory module 5 may also be an external DDR. In addition, when the display panel is rectangular, as shown in FIG. 8 and FIG. 9, the display panel may further include non-attention areas 83 which are located at four corner areas of the display panel. Usage frequencies of pixels in the core attention area 81, the secondary attention area 82 and the non-attention area 83 are sequentially decreased, and then interference degrees of the driving-control sub-modules 41 corresponding to sub-regions 214 in the core attention area 81, the secondary attention area 82 and the non-attention area 83 are sequentially increased. Further, the display sub-area 21 has an intersection with the core attention area 81, the secondary attention area 82 and the non-attention area 83. The first display sub-area 211 includes the core attention area 81 and the secondary attention area 82. A shape of an ideal boundary of the core attention area 81 is elliptical or circular. When a part of one sub-region 214 is within the ideal boundary and a part of the one sub-region 214 is outside the ideal boundary, if a proportion of the part within the ideal boundary is greater than a proportion of the part outside the ideal boundary, the one sub-region 214 is classified into the core attention area 81; otherwise the one sub-region 214 is classified into the secondary attention area 82. The second display sub-area 212 also includes the core attention area 81 and the secondary attention area 82. The third display sub-area 213 includes the core attention area 81, the secondary attention area 82 and the non-attention area 83. Specifically, as shown in FIG. 9, the display panel is divided into 48 sub-regions 214 as an example, where each row includes 8 sub-regions 214, and there are a total of 6 columns. Regions 4, 5, 12, 13, 20, 21, 28, 29, 36, 37, 44 and 45 belong to the first display sub-area 211. The regions 12, 13, 20, 21, 28, 29, 36 and 37 in the first display sub-area 211 belong to the core attention area 81. Regions 3, 11, 19, 27, 35, 43, 6, 14, 22, 30, 38 and 46 belong to the second display sub-areas 212. The regions 11, 19, 27, 35, 14, 22, 30 and 38 in the second display sub-areas 212 belong to the core attention area 81, and other regions belong to the secondary attention area 82. All regions except for the above regions belong to the third display subarea 213. Regions 1, 8, 41 and 48 in the third display sub-area 213 belong to the non-attention area 83. Regions 18, 26, 23 and 31 in the third display sub-area 213 belong to the core attention area 81. The rest regions in the third display sub-area 213 belong to the secondary attention area 82. In the foregoing embodiment, the core attention area 81, the secondary attention area 82 and the non-attention area 83 all belong to multiple attention areas. In addition, regional division of multiple core attention areas may also be performed in other division manners, which may be determined according to characteristics of the displayed demo.

According to a second aspect of the present application, a display device is provided and includes the display panel provided in any of the above embodiments, and therefore includes all the beneficial effects of the display panel provided in any of the above embodiments, which will not be repeated here.

Figure 15:
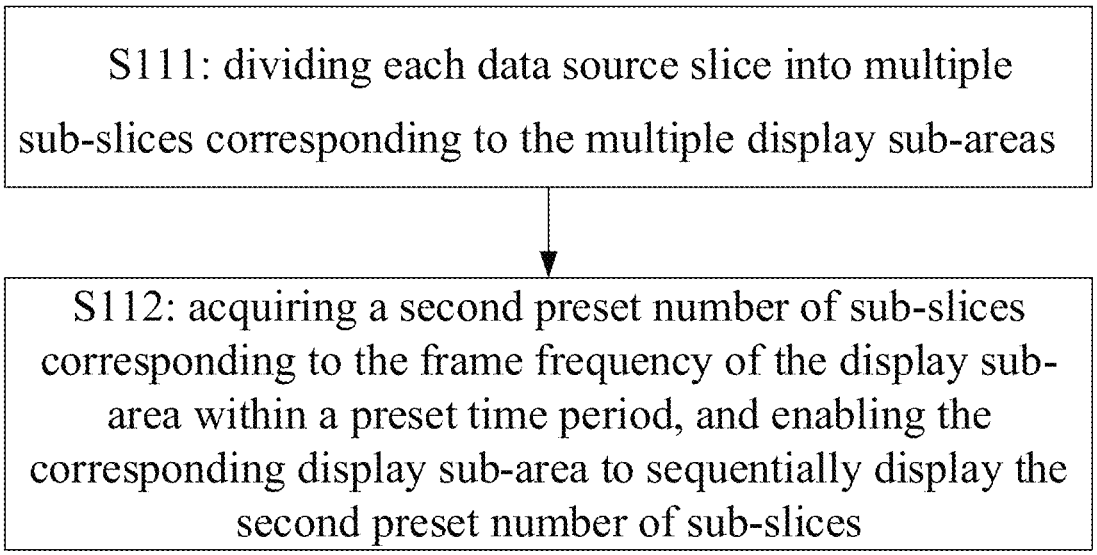
FIG. 15 is a flow chart of a method for driving a display panel according to an embodiment of the present application.

According to a third aspect of the present application, a method for driving a display panel is provided and may be applied to the display panel provided in any of the above embodiments. As shown in FIG. 15, the method includes:

S1: dividing a display panel into areas according to a division rule, where the division rule includes dividing the display panel into multiple display sub-areas 21 along a direction from a rotation axis 1 to a display area 2; wherein the display panel rotates around the rotation axis 1, the display area 2 is located on at least one side of the rotation axis 1; when the display panel rotates around the rotation axis 1, areas passed by the plurality of display sub-areas 21 form a plurality of imaging sub-areas;

S2: controlling the multiple display sub-areas 21 to have different display parameters, so that imaging brightness of the multiple imaging sub-areas are within a preset brightness range.

Two display areas 2 may be symmetrically arranged, that is, the two display areas 2 are located at two sides of the rotation axis 1. Then, the multiple display sub-areas 21 in the two display areas 2 are also symmetrically arranged with the rotation axis 1 as an axis of symmetry. Alternative, only one display area 2 is provided at one side of the rotation axis 1. In order to enable the display sub-areas 21 to have different display parameters, a driving-control module 4 is provided for each display sub-area 21. Each driving-control module 4 correspondingly controls one display sub-area 21, to enable various display sub-areas 21 to have different display parameters, so that the imaging brightness of multiple imaging sub-areas are within the preset brightness range.

Specifically, controlling the multiple display sub-areas 21 to have different display parameters in the step S2 specifically includes:

S11: controlling frame frequencies of the multiple display sub-areas 21, which are arranged sequentially along the direction from the rotation axis 1 to the display area 2, to increase sequentially, where the frame frequency is the display parameter.

In this way, by sequentially increasing the frame frequencies of the display sub-areas 21 arranged sequentially along the first direction, it can ensure that arrangement densities of voxels in multiple imaging sub-areas are the same, i.e., enabling imaging brightness of multiple imaging sub-areas to be the same.

Specifically, as shown in FIG. 15, controlling frame frequencies of the multiple display sub-areas 21, which are arranged sequentially along the direction from the rotation axis 1 to the display area 2, to increase sequentially, in the step S11, includes:

S111: dividing each data source slice 7 into multiple sub-slices corresponding to the multiple display sub-areas 21;

S112: acquiring a second preset number of sub-slices corresponding to the frame frequency of the display sub-area 21 within a preset time period, and enabling the corresponding display sub-area 21 to sequentially display the second preset number of sub-slices.

DDR acquires the data source slice 7 through the communication module, and transmits the data source slice 7 to the partition module 6 under control of the display control module 9. The partition module 6 divides each data source slice 7 into multiple sub-slices corresponding to multiple display sub-areas 21. Within the preset time period, the number of data source slices 7 transmitted by DDR is the first preset number, and the number of sub-slices received by the driving-control module 4 is controlled by the frame frequency of the display sub-area 2 corresponding to the driving-control module 4.

Specifically, the display parameter is display brightness.

Specifically, controlling the multiple display sub-areas 21 to have different display parameters in the step S2 specifically includes:

S12: controlling display brightness of the multiple display sub-areas 21, which are arranged sequentially along the direction from the rotation axis 1 to the display area 2, to increase sequentially.

The above are merely the embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure. The protection scope of the present disclosure shall be subject to the protection scope of the claims.

What is claimed is:

1. A display panel, comprising:

a rotation axis;

at least one display area located at one side of the rotation axis; wherein the display area includes a plurality of display sub-areas; and a plurality of driving-control circuits corresponding to the plurality of display sub-areas;

wherein the plurality of display sub-areas are sequentially arranged along a first direction; the first direction is directed from the rotation axis to the display area; when the display panel rotates around the rotation axis, areas passed by the plurality of display sub-areas form a plurality of imaging sub-areas;

the plurality of driving-control circuits are configured to control the plurality of display sub-areas to have different display parameters, respectively, thereby enabling imaging brightness of the plurality of imaging sub-areas to be within a preset brightness range, wherein the display parameters are frame frequencies; and the plurality of the driving-control circuits are configured to control the plurality of the display sub-areas to have different frame frequencies and the frame frequencies of the plurality of the display sub-areas to be increased sequentially along the first direction, wherein the display panel further includes: a memory module and a partition circuit the memory module is electrically coupled to the partition circuit the partition circuit is electrically coupled to the plurality of driving-control circuits;

within a preset time, the memory module is configured to transmit a first preset number of data source slices to the partition circuit;

the partition circuit is configured to divide each data source slice into a plurality of sub-slices corresponding to the plurality of display sub-areas, and transmit the plurality of sub-slices to the plurality of driving-control circuits, respectively;

each of the plurality of driving-control circuits is configured to receive a second preset number of the sub-slices according to the frame frequency of the display sub-area corresponding to the each of the plurality of driving-control circuits, and control the display sub-area corresponding to the each of the plurality of driving-control circuits to sequentially display the second preset number of the sub-slices;

the second preset number is less than or equal to the first preset number.

2. The display panel according to claim 1, wherein the numbers of the sub-slices received by the plurality of driving-control circuits corresponding to the plurality of the display sub-areas are increased sequentially along the first direction.

3. The display panel according to claim 1, wherein the plurality of display sub-areas include a first display sub-area, a second display sub-area and a third display sub-area which are sequentially arranges along the first direction;

the plurality of sub-slices include a first sub-slice, a second sub-slice and a third sub-slice; the first sub-slice, the second sub-slice and the third sub-slice are corresponding to the first display sub-area, the second display sub-area and the third display sub-area, respectively;

the plurality of driving-control circuits at least include:

a first driving-control circuit configured to receive a third preset number of first sub-slices and control the first display sub-area to sequentially display the third preset number of the first sub-slices;

a second driving-control circuit configured to receive a fourth preset number of second sub-slices and control the second display sub-area to sequentially display the fourth preset number of the second sub-slices; and a third driving-control circuit configured to receive the fourth preset number of third sub-slices and control the third display sub-area to sequentially display the fourth preset number of the third sub-slices;

wherein when the third display sub-area displays the third sub-slices, two adjacent frame groups sequentially display two different third sub-slices, each frame group includes at least two frames, and a same third sub-slice is displayed in all frames of each frame group; the third preset number is less than the fourth preset number.

4. The display panel according to claim 1, wherein each of the plurality of driving-control circuits includes: an output control unit, a drive-chip control unit and a drive chip; the output control unit is electrically coupled to the partition circuit; the drive-chip control unit is electrically coupled to the output control unit; the drive chip is electrically coupled to the drive-chip control unit;

the drive-chip control unit is configured to control the output control unit to output a second preset number of the sub-slices, according to the frame frequency of the display sub-area corresponding to the each of the plurality of driving-control circuits;

the drive chip is configured to receive the second preset number of the sub-slices and drive the display sub-area corresponding to the each of the plurality of driving-control circuits to sequentially display the second preset number of the sub-slices.

5. The display panel according to claim 1, wherein there is one display area at each side of the rotation axis, and the two display areas are symmetrically arranged with the rotation axis as an axis of symmetry; the plurality of display sub-areas in the two display areas are symmetrically arranged; in the two display areas, the display sub-areas at the same distance from the rotation axis are corresponding to the same driving-control circuit;

or, the display area is at one side of the rotation axis.

6. The display panel according to claim 1, wherein the display parameters are display brightness; and the display brightness of the plurality of display sub-areas are increased sequentially along the first direction.

7. The display panel according to claim 1, wherein each of the plurality of display sub-areas includes a plurality of sub-regions; each of the plurality of driving-control circuits includes a plurality of driving-control sub-circuits corresponding to the plurality of sub-regions in a one-to-one manner; the plurality of driving-control sub-circuits are configured to control the display parameters of the plurality of sub-regions, respectively; the display parameters of the sub-regions in the same display sub-area are the same.

8. The display panel according to claim 7, wherein all of the plurality of sub-regions are divided into a plurality of attention areas; the driving-control sub-circuits corresponding to a plurality of sub-regions in the plurality of attention areas have different levels of interference.

9. A method for driving the display panel according to claim 1, comprising:

dividing the display panel into areas according to a division rule, wherein the division rule includes dividing the display panel into a plurality of display sub-areas along a direction from a rotation axis to a display area; wherein the display panel includes a rotation axis for rotation, the display area is located on at least one side of the rotation axis; when the display panel rotates around the rotation axis, areas passed by the plurality of display sub-areas form a plurality of imaging sub-areas; and controlling the plurality of display sub-areas to have different display parameters, thereby enabling imaging brightness of the plurality of imaging sub-areas to be within a preset brightness range.

10. The method according to claim 9, wherein the controlling the plurality of display sub-areas to have different display parameters, includes:

controlling frame frequencies of the plurality of display sub-areas, which are arranged sequentially along the direction from the rotation axis to the display area, to be increased sequentially; wherein the frame frequencies are the display parameters.

11. The method according to claim 10, wherein the controlling frame frequencies of the plurality of display sub-areas, which are arranged sequentially along the direction from the rotation axis to the display area, to be increased sequentially, includes:

dividing each data source slice into a plurality of sub-slices corresponding to the plurality of display sub-areas;

acquiring a second preset number of sub-slices corresponding to the frame frequency of each of the plurality of display sub-areas within a preset time period, and enabling the each of the plurality of display sub-areas to sequentially display the second preset number of sub-slices.

12. The method according to claim 9, wherein the display parameters are display brightness; the controlling the plurality of display sub-areas to have different display parameters, includes:

controlling display brightness of the plurality of display sub-areas, which are arranged sequentially along the direction from the rotation axis to the display area, to be increased sequentially.

13. A display device, comprising a display panel with a rotation axis;

wherein the display panel comprises:

at least one display area located at one side of the rotation axis; wherein the display area includes a plurality of display sub-areas; and a plurality of driving-control circuits corresponding to the plurality of display sub-areas in a one-to-one manner;

wherein the plurality of display sub-areas are sequentially arranged along a first direction; the first direction is directed from the rotation axis to the display area; when the display panel rotates around the rotation axis, areas passed by the plurality of display sub-areas form a plurality of imaging sub-areas;

the plurality of driving-control circuits are configured to control values of display parameters of the plurality of display sub-areas to be monotonically changed along the first direction, thereby enabling imaging brightness of the plurality of imaging sub-areas to be within a preset brightness range, wherein the display parameters are frame frequencies; and the plurality of the driving-control circuits are configured to control the plurality of the display sub-areas to have different frame frequencies and the frame frequencies of the plurality of the display sub-areas to be increased sequentially along the first direction, wherein the display panel further includes: a memory module and a partition circuit the memory module is electrically coupled to the partition circuit the partition circuit is electrically coupled to the plurality of driving-control circuits;

within a preset time, the memory module is configured to transmit a first preset number of data source slices to the partition circuit;

the partition circuit is configured to divide each data source slice into a plurality of sub-slices corresponding to the plurality of display sub-areas, and transmit the plurality of sub-slices to the plurality of driving-control circuits, respectively;

each of the plurality of driving-control circuits is configured to receive a second preset number of the sub-slices according to the frame frequency of the display sub-area corresponding to the each of the plurality of driving-control circuits, and control the display sub-area corresponding to the each of the plurality of driving-control circuits to sequentially display the second preset number of the sub-slices;

the second preset number is less than or equal to the first preset number.

14. The display device according to claim 13, wherein the display parameters are display brightness; and the display brightness of the plurality of display sub-areas are increased sequentially along the first direction.

15. The display device according to claim 13, wherein the numbers of the sub-slices received by the plurality of driving-control circuits corresponding to the plurality of the display sub-areas are increased sequentially along the first direction.

16. The display device according to claim 13, wherein the plurality of display sub-areas include a first display sub-area, a second display sub-area and a third display sub-area which are sequentially arranges along the first direction;

the plurality of sub-slices include a first sub-slice, a second sub-slice and a third sub-slice; the first sub-slice, the second sub-slice and the third sub-slice are corresponding to the first display sub-area, the second display sub-area and the third display sub-area, respectively;

the plurality of driving-control circuits at least include:

a first driving-control circuit configured to receive a third preset number of first sub-slices and control the first display sub-area to sequentially display the third preset number of the first sub-slices;

a second driving-control circuit configured to receive a fourth preset number of second sub-slices and control the second display sub-area to sequentially display the fourth preset number of the second sub-slices; and a third driving-control circuit configured to receive the fourth preset number of third sub-slices and control the third display sub-area to sequentially display the fourth preset number of the third sub-slices;

wherein when the third display sub-area displays the third sub-slices, two adjacent frame groups sequentially display two different third sub-slices, each frame group includes at least two frames, and a same third sub-slice is displayed in all frames of each frame group; the third preset number is less than the fourth preset number.

17. A display panel, comprising:

a rotation axis;

at least one display area located at one side of the rotation axis; wherein the display area includes a plurality of display sub-areas; and a plurality of driving-control circuits corresponding to the plurality of display sub-areas;

wherein the plurality of display sub-areas are sequentially arranged along a first direction; the first direction is directed from the rotation axis to the display area; when the display panel rotates around the rotation axis, areas passed by the plurality of display sub-areas form a plurality of imaging sub-areas;

the plurality of driving-control circuits are configured to control the plurality of display sub-areas to have different display parameters, respectively, thereby enabling imaging brightness of the plurality of imaging sub-areas to be within a preset brightness range, wherein each of the plurality of display sub-areas includes a plurality of sub-regions; each of the plurality of driving-control circuits includes a plurality of driving-control sub-circuits corresponding to the plurality of sub-regions in a one-to-one manner; the plurality of driving-control sub-circuits are configured to control the display parameters of the plurality of sub-regions, respectively; the display parameters of the sub-regions in the same display sub-area are the same, wherein all of the plurality of sub-regions are divided into a plurality of attention areas; the driving-control sub-circuits corresponding to a plurality of sub-regions in the plurality of attention areas have different levels of interference.

* * * * *